US005718646A

United States Patent [19]

Brewer

[11] Patent Number: 5,718,646

[45] Date of Patent: Feb. 17, 1998

[54] GOLF TEE INSERTER

[76] Inventor: Russell S. Brewer, 2840 S. 308 La., Federal Way, Wash. 98003

[21] Appl. No.: 633,542

[22] Filed: Apr. 17, 1996

[51] Int. Cl.[6] ..... A63B 57/00

[52] U.S. Cl. ..... 473/386; 473/284

[58] Field of Search ..... 473/282, 284, 473/286, 285, 386, 131, 400; 294/19.1, 19.2

[56] References Cited

U.S. PATENT DOCUMENTS

| | | | |
|---|---|---|---|
| 1,634,652 | 7/1927 | Czichos | 473/284 |
| 1,852,956 | 4/1932 | Czichos | 473/284 |
| 1,902,682 | 3/1933 | Walrath | 473/386 |
| 2,083,175 | 6/1937 | Werner | 473/284 |
| 2,606,764 | 8/1952 | Mason | 473/386 |
| 2,943,856 | 7/1960 | Eimerman | 473/386 |
| 3,633,919 | 1/1972 | Liccardello . | |
| 4,142,719 | 3/1979 | Blood . | |
| 4,989,868 | 2/1991 | Manko . | |
| 5,154,417 | 10/1992 | Kohli . | |
| 5,299,846 | 4/1994 | Rush | 473/286 |
| 5,370,388 | 12/1994 | Wehner . | |
| 5,403,006 | 4/1995 | Korte-Jungermann | 473/284 |

*Primary Examiner*—Steven B. Wong

[57] ABSTRACT

The present invention relates to a golf tee inserter (10) and method of utilization. The golf tee inserter (10) has a housing (12) manufactured from a resilient flexible material. The housing (12) has a tee housing (12A) which comprises a tee housing grip (12AB) having a tee housing grip opening (12ABA) therein, a golf tee ball rest (18A) of a golf tee (18) is inserted through the tee housing grip opening (12ABA) and into the tee housing grip (12AB) functioning to removably and securely hold the golf tee (18) therein and a handle housing (12B) securely attached to the tee housing (12A) by a transition housing (12C), the handle housing (12B) having a handle housing opening (12BA) within which a distal end of a golf club handle (16A) is inserted. An optional tee housing lip (12AA) may be present in an embodiment of the invention. The tee housing lip (12AA) extends from the tee housing grip (12AB) and is variable in height. The tee housing lip (12AA) functions to determine a desired depth that a golf tee shaft (18B) of the golf tee (18) when inserted into a ground (14).

3 Claims, 3 Drawing Sheets

GOLF TEE INSERTER

BACKGROUND OF THE INVENTION

1. Field of the Invention

The present invention relates to a golf tee inserter. More particularly, the present invention relates to golf tee inserter which is mounted at a distal end of a handle and removably holds a golf tee therein. The golf tee is then inserted into the ground by inverting the golf club pushing the tee therein.

2. Description of the Prior Art

The prior art teaches golf tee insertion devices which are hand held but none are mountable at the end of a golf club. While the prior art devices will aid a user in the insertion of a golf tee into the ground, the golfer must still bend over to do so. The present invention allows insertion of the golf tee from a standing upright position which eliminates undo back stress.

Numerous innovations for golf tee insertion devices have been provided in the prior art that are described as follows. Even though these innovations may be suitable for the specific individual purposes to which they address, they differ from the present invention as hereinafter contrasted.

In U.S. Pat. No. 3,633,919 titled Golf Tee Having a Separable Turf Inserting Part invented by Liccardello comprises a golf tee having a hollow flexible bendable stem, a rigid turf inserting part fastened to the stem at the bottom thereof and another rigid turf inserting part separable from the stem. The other turf inserting part has an enlarged head and a pointed shank extending therefrom. The shank is insert able into the hollow of the stem for pushing upon the first mentioned turf inserting part to insert the tee in the ground.

The above patented invention differs from the present invention because it inserts and fits over the end of the golf club, inserts a golf tee into hard and/or frozen ground, and constructed from one-piece molding. In addition, the patented invention does not adjust for height of tee placement.

In U.S. Pat. No. 4,142,719 titled Golf Tee Insertion Device invented by Blood comprises a device for facilitating the insertion of a golf tee into the ground under controlled conditions of height and angulation independent of ground surface conditions. The device permits controlled golf tee insertion without bending or stooping through the use of a tee holding head wherein the tee is held in place by spaced apart arm or spring elements extending downward from the outer diameter of a terminal end of a rod housed in a height adjustment sleeve, the sleeve or chamber is provided with spaced apart cutouts which receive the spring arm elements and allow them to be forced apart when a tee head is forced therebetween the rod having a bearing surface which is substantially contoured to fit the concave upper surface of a standard golf tee head. The height adjustment sleeve, spaced apart arm elements, vertical tee alignment and contoured beating surface permit the tee to be inserted into the ground to a predetermined indicated tee height without disturbing the initial positioning and alignment of the tee due to the action of kinetic energy resulting from insertion thrust. The ground friction overcomes the holding friction exerted on the tee by the insertion device once the tee has been inserted into the ground and the insertion device is lifted up and away from the ground.

The above patented invention differs from the present invention because it inserts, fits over the end of the golf club and is constructed from one-piece molding and costs much less to manufacture. In addition, the patented invention does not adjust for height of tee placement.

In U.S. Pat. No. 4,989,868 titled Golf Tee Tool comprises a tool for placing a golf tee into the ground such as to maintain a golf ball at a predetermined height above the ground. A pair of disks are interconnected by a cylindrical body, an upper portion of which is of a hollow nature. A slot passes through a solid bottom portion of the body and the bottom disk. The upper hollow portion is semicircular in cross section and in combination with the slot adapts the tool for receiving a golf tee therein. With the tee so received, it can be placed into the ground such that the tee extends above the ground a distance fixed by the separation between the two disks.

The above patented invention differs from the present invention because it inserts, fits over the end of the golf club, inserts golf tee into hard and/or frozen ground and constructed from one-piece molding and costs much less to manufacture. In addition, the patented invention does not adjust for height of tee placement.

In U.S. Pat. No. 5,154,417 titled Golf Tee comprises a golf tee having a tough, resilient body made of a polymeric material which will not damage the club face upon impact and has a reinforcing member in the form of a pin inserted longitudinally thereof to provide stiffness so that the tee may be inserted into the ground without breaking or bending.

The above patented invention differs from the present invention because it inserts, fits over the end of the golf club and is constructed from one-piece molding.

In U.S. Pat. No. 5,370,388 titled Apparatus and Method for Setting a Golf Tee invented by Wehner comprises an apparatus for inserting a golf tee with a head having an underside, and a shaft extending from the underside of the head into the ground the apparatus comprises a one piece body member having a first end defining a threaded opening and a second end having a chamber and a shaped notch in communication with the chamber. The chamber of the one piece body member has a circumferentially enclosed portion for containing and supporting the head of the tee as it slides to the screw member during insertion. The notch is adapted for receiving the head of the tee within the chamber. The shaped notch has a support surface upon which the underside of the head of the tee freely rests, a bottom opposing the support surface and a slot extending between the support surface and the bottom through which the shank of the golf tee extends from the chamber with the tee held in the chamber only by the underside of the head. There is also a screw member having a threaded shaft with a face.

The above patented invention differs from the present invention because it inserts, fits over the end of the golf club, and is constructed from one-piece molding and costs much less to manufacture. In addition, the patented invention does not adjust for height of tee placement.

Numerous innovations for golf tee insertion devices have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a golf tee insertion device which is mounted on at a distal end of a golf club handle. The golfer inserts the tee into the ground by inverting the golf club into a downward position and pushes thereon inserting the tee therein. The golf club is then raised releasing the golf tee from the golf tee inserter.

The types of problems encountered in the prior art are previous golf tee inserters required the user to constantly bend over resulting in undo stress on one's back.

In the prior art, unsuccessful attempts to solve this problem were attempted namely: manual hand held insertable golf tee devices. However, the problem was solved by the present invention because it is mountable at a distal end of the golf club handle.

Innovations within the prior art are rapidly being exploited in the field of reducing back stress during sports.

The present invention went contrary to the teaching of the art which describes manual hand held golf tee insertion devices.

The present invention solved a long felt need for a device to insert a golf tee while the golfer remains in a standing upright position.

The present invention produced unexpected results namely: increased leverage is gained by utilizing the golf club as an insertion tool which aids in golf tee insertion into hard and/or frozen ground.

Accordingly, it is an object of the present invention to provide a golf tee inserter.

More particularly, it is an object of the present invention to provide a golf tee inserter having a housing.

In keeping with these objects, and with others which will become apparent hereinafter, one feature of the present invention resides, briefly stated, in the housing comprising a tee housing, a handle housing and a transition housing therebetween.

When the tee housing is designed in accordance with the present invention, it comprises a tee housing lip and a tee housing grip with a tee housing grip opening therein.

Another feature of the present invention is the handle housing.

Another feature of the present invention is that the handle housing has a handle housing opening.

The novel features which are considered characteristic for the invention are set forth in the appended claims. The invention itself; however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10-golf tee inserter (10)
12-housing (12)
12A-tee housing (12A)
12AA-tee housing lip (12AA)
12AB-tee housing grip (12AB)
12ABA-tee housing grip opening (12ABA)
12B-handle housing (12B)
12BA-handle housing opening (12BA)
12C-transition housing (12C)
14-ground (14)
16-golf club (16)
16A-golf club handle (16A)
16B-golf club shaft (16B)
18-golf tee (18)
18A-golf tee ball rest (18A)
18B-golf tee shaft (18B)
20-user's second hand (20)

DESCRIPTION OF THE PREFERRED EMBODIMENT

Figure 1:
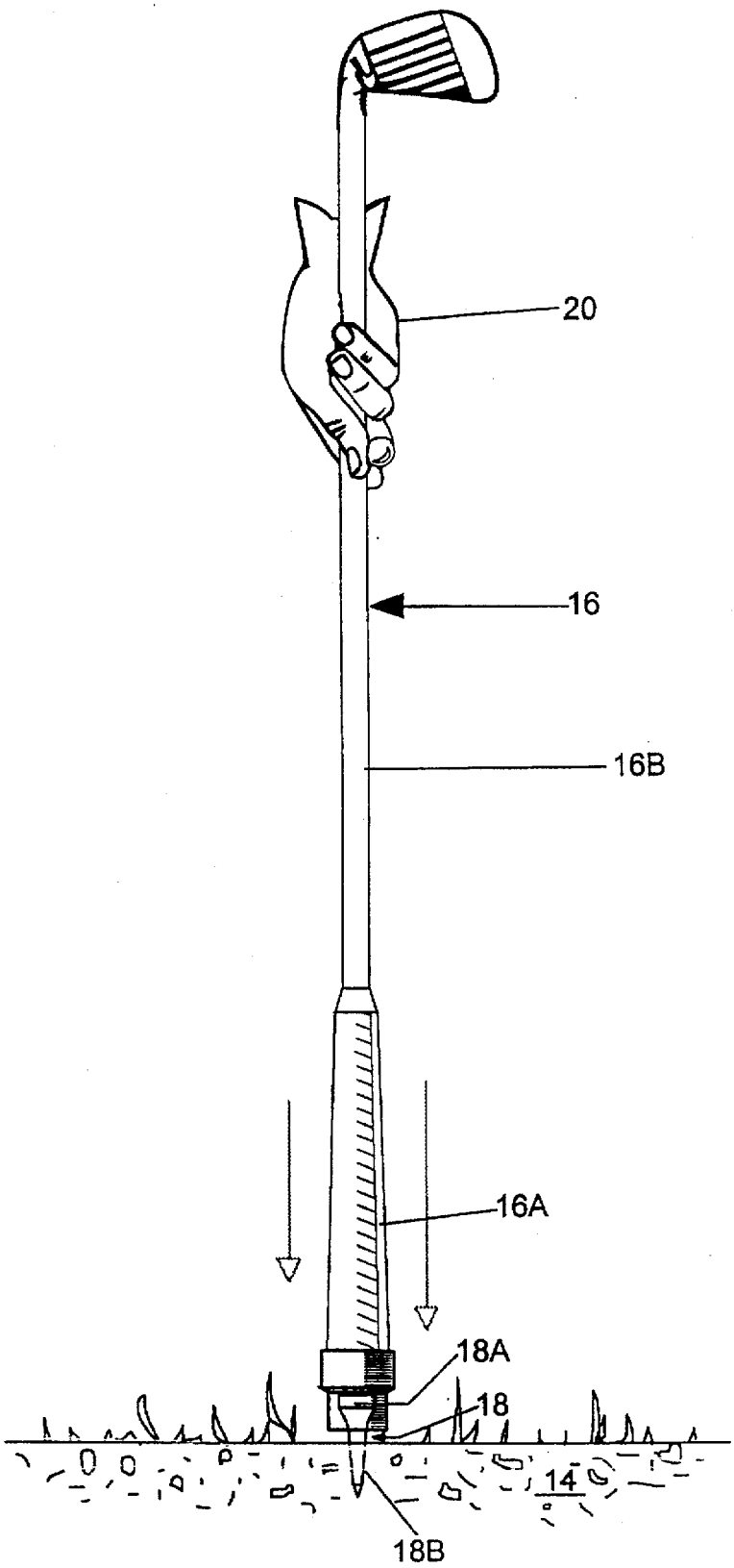
FIG. 1 is a side view of a golf tee inserter inserting a golf tee into the ground.

Firstly, referring to FIG. 1 which is a side view of a golf tee inserter (10) inserting a golf tee (18) into the ground (14). A method of inserting a golf tee (18) into the ground (14) utilizing the golf tee inserter (10) consists of the following steps:

A) mounting a golf tee inserter (10) onto a golf club handle (16A) by inserting a handle housing (12B) having a handle housing opening (12BA) over a distal end of the golf club handle (16A) until stoppage at a transition housing (12C) occurs;

B) holding a golf club (16) by the golf club handle (16A) in a first hand in an upright position;

C) grasping a golf tee (18) by a golf tee shaft (18B) in a second hand (20);

D) inserting a golf tee ball rest (18A) into a tee housing (12A) through a tee housing grip opening (12ABA) which in turn holds the golf tee (18) in the golf tee inserter (10) by a tee housing grip (12AB);

E) grasping a golf club shall (16B) in the second hand (20);

F) inverting the golf club (16);

G) pushing the golf club (16) in a downward direction which in turn pushes the golf tee shaft (18B) into a ground (14); and H) pulling the golf club (16) in an upright direction which in turn releases the golf tee ball rest (18A) from the tee housing grip (12AB).

The housing (12) is preferably manufactured from a flexible resilient material selected from a group consisting of plastic, plastic composites, rubber and rubber composites. The handle housing (12B) has a handle housing opening (12BA) which is preferably slightly smaller than the outside diameter of a golf club handle (16A) thereby securely holding it thereon. The tee housing (12A) has a tee housing grip (12AB) with a tee housing grip opening (12ABA) therein. The tee housing (12A) is flexible which permits a user to easily insert a golf tee ball rest (18A) therein and further permits easy release thereof after the golf tee shaft (18B) is inserted into the ground (14). A tee housing lip (12AA) is optional but if present can be made a desired length such that a user can easily insert the golf tee shaft (18B) into the ground (14) to a desired depth by adjusting the height of the tee housing lip (12AA). The tee housing lip (12AA) functions as a stopping means when it comes in contact with the ground (14) upon insertion of the golf tee shaft (18B) therein.

Figure 2:
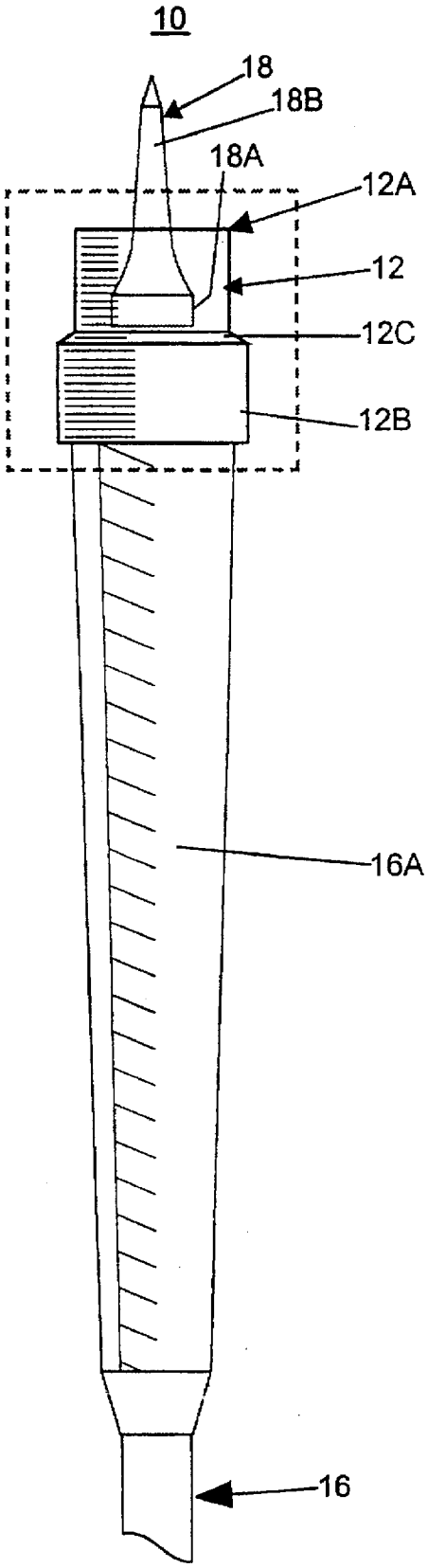
FIG. 2 is an enlarged side view of a golf tee inserter mounted at a distal end of a golf club handle.

Referring to FIG. 2 which is an enlarged side view of a golf tee inserter (10) mounted at a distal end of a golf club handle (16A). The golf tee ball rest (18A) is inserted into the tee housing (12A) until it comes in contact with the transition housing (12C) which is adjacent to the distal end of the golf club handle (16A). The tee housing grip (12AB) can be configured complimentary to the golf tee ball rest (18A) functioning to more securely hold the golf tee (18) thereon during insertion.

Figure 3:
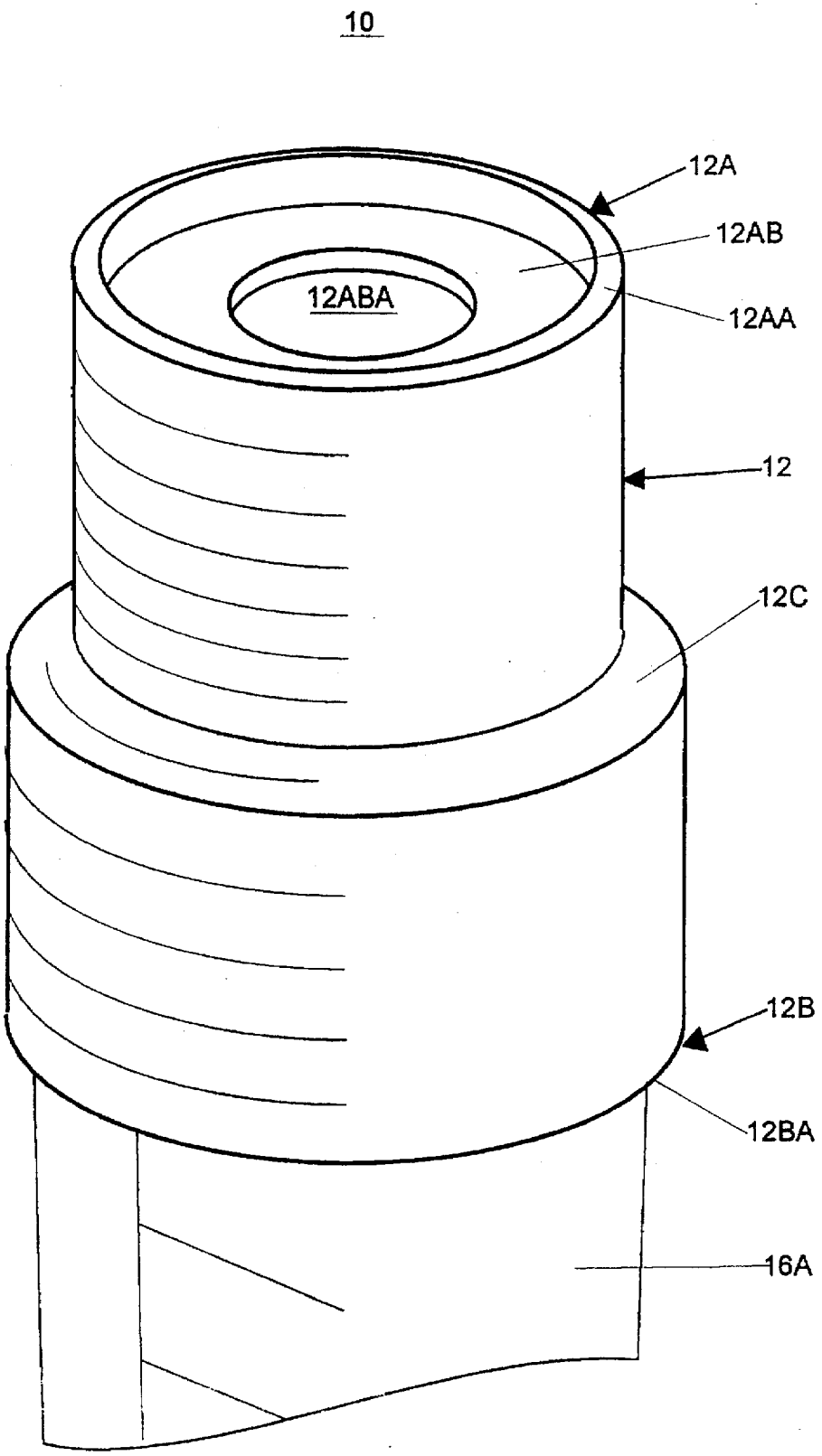
FIG. 3 is an enlarged perspective view of a golf tee inserter mounted at a distal end of a golf club handle exhibiting a tee housing having a tee housing grip through which a golf tee ball rest is inserted.

Lastly, referring to FIG. 3 which is an enlarged perspective view of a golf tee inserter (10) mounted at a distal end of a golf club handle (16A) exhibiting a tee housing (12A) having a tee housing grip (12AB) through which a golf tee ball rest (18A) is inserted. The inside diameter of the tee housing grip opening (12ABA) is complimentary to the outside diameter of the golf tee shaft (18B) functioning to securely hold the golf tee (18) within the tee housing (12A) of the golf tee inserter (10).

It will be understood that each of the elements described above, or two or more together, may also find a useful application in other types of constructions differing from the type described above.

While the invention has been illustrated and described as embodied in a golf tee inserter, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A golf tee inserter (10) manufactured from a flexible resilient material, the golf tee inserter (10) comprising:

A) a housing (12) which comprises:

I) a tee housing (12A) which comprises a tee housing grip (12AB) having a tee housing grip opening (12ABA) therein, the tee housing grip opening (12ABA) with a complimentary diameter to the diameter of a golf tee (18), adapted for receiving a golf tee ball rest (18A) of the golf tee (18), the golf tee (18) is inserted through the tee housing grip opening (12ABA) and into the tee housing grip (12AB) functioning to removably and securely hold the golf tee (18) therein, the tee housing (12A) further has a tee housing lip (12AA) having solid sides extending from the tee housing grip (12AB), the tee housing lip (12AA) functions to determine a desired depth that a golf tee shaft (18B) of the golf tee (18) is inserted into a ground (14); and II) a handle housing (12B) securely attached to the tee housing (12A) by a transition housing (12C), the handle housing (12B) having a handle housing opening (12BA) within which a distal end of a golf club handle (16A) is inserted.

2. The golf tee inserter (10) as described in claim 1, wherein the flexible resilient material is selected from a group of materials consisting of plastic, plastic composite, rubber, and rubber composite.

3. A method of utilizing a golf tee inserter (10) consisting of the following steps:

A) mounting a golf tee inserter (10) onto a golf club handle (16A) by inserting a handle housing (12B) having a handle housing opening (12BA) over a distal end of the golf club handle (16A) until stoppage at a transition housing (12C) occurs;

B) holding a golf club (16) by the golf club handle (16A) in a first hand in an upright position;

C) grasping a golf tee (18) by a golf tee shaft (18B) in a second hand (20);

D) inserting a golf tee ball rest (18A) into a tee housing (12A) through a tee housing grip opening (12ABA) which in turn holds the golf tee (18) in the golf tee inserter (10) by a tee housing grip (12AB);

E) gasping a golf club shaft (16B) in the second hand (20);

F) inverting the golf club (16);

G) pushing the golf club (16) in a downward direction which in turn pushes the golf tee shalt (18B) into a ground (14); and H) pulling the golf club (16) in an upright direction which in turn releases the golf tee ball rest (18A) from the tee housing grip (12AB).

* * * * *